United States Patent [19]

Rambo

[11] Patent Number: 4,840,516

[45] Date of Patent: Jun. 20, 1989

[54] ARTIFICIAL REEF

[76] Inventor: Thomas A. Rambo, 155 Lake Ave., Riverhead, N.Y. 11901

[21] Appl. No.: 254,814

[22] Filed: Oct. 7, 1988

[51] Int. Cl.[4] ..... E02B 3/06

[52] U.S. Cl. ..... 405/33; 405/30

[58] Field of Search ..... 405/21, 23, 25, 28–35

[56] References Cited

U.S. PATENT DOCUMENTS

| | | | |
|---|---|---|---|
| 1,353,001 | 9/1920 | Uriante | 405/35 |
| 3,415,061 | 12/1968 | Staempfli | 405/34 |
| 3,548,600 | 12/1970 | Stolk et al. | 405/30 |
| 3,845,630 | 11/1974 | Karnas | 405/30 |
| 4,064,700 | 12/1977 | Sameshima | 405/30 |
| 4,129,006 | 12/1978 | Payne | 405/31 |
| 4,188,153 | 2/1980 | Taylor | 405/34 |
| 4,269,537 | 5/1981 | O'Neill | 405/29 |
| 4,341,489 | 7/1982 | Karnas | 405/35 |
| 4,397,578 | 8/1983 | Inman | 405/33 |
| 4,479,740 | 10/1984 | Schaaf et al. | 405/33 X |

FOREIGN PATENT DOCUMENTS

| | | | |
|---|---|---|---|
| 0122906 | 9/1980 | Japan | 405/30 |
| 1145397 | 3/1985 | U.S.S.R. | 405/30 |
| 473874 | 10/1937 | United Kingdom | 405/30 |

*Primary Examiner*—David H. Corbin
*Assistant Examiner*—Arlen L. Olsen
*Attorney, Agent, or Firm*—Jerry T. Kearns

[57] ABSTRACT

An artificial reef for inhibiting beach erosion is formed from a plurality of connected adjacent blocks, each having a base with inclined front and back walls connected by vertical side walls and a flat bottom surface. A plurality of rectangular vertical columns are spaced along an upper surface of the base and are sequentially stepped in height from the front and back walls to a maximum height adjacent a mid-portion of the base. A plurality of vertically spaced saw toothed wave forms extend along the base, in aligned pairs on opposite sides of the columns. A plurality of pairs of aligned triangular surfaces project from front and back walls of each column, spaced vertically along the columns in alignment with the saw toothed wave forms. The blocks are assembled in side by side relation, with each block alternately having downwardly extending trapezoidal prismatic projections or mating recesses. When assembled, the blocks form a plurality of interior intersecting passages extending in first and second perpendicular directions. The interior passages have a corrugated interior surface and serve to absorb wave energy from obliquely approaching waves and direct the water flow therefrom either perpendicular to or parallel with the beach line. This prevents erosion of the beach through latorial drift.

19 Claims, 4 Drawing Sheets

ARTIFICIAL REEF

BACKGROUND OF THE INVENTION

1. Field of the Invention

The present invention relates to artificial reefs, and more particularly pertains to man made barriers for placement along beaches to prevent erosion. The erosion of beaches is a substantial problem along the coasts of the United States and throughout the world. Waves which obliquely approach the beach line cause a lateral drifting or erosion of the beach known as latorial drift. This phenomena has caused the expenditure of millions of dollars in sand pumping and other beach reconstruction projects. In order to overcome this problem, and to provide an economical alternative to such reconstruction projects, the present invention provides an improved man made artificial reef to prevent beach erosion.

2. Description of the Prior Art

Various types of artificial reefs are known in the prior art. A typical example of such an artificial reef is to be found in U.S. Pat No. 1,353,001, which issued to G. Uriarte on Sept. 14, 1920. This patent discloses a plurality of adjacent blocks having spaced vertical columns and perpendicularly extending horizontal beams which form perpendicular intersecting interior passages. U.S. Pat. No. 3,415,061, which issued to A. Staempfli on Dec. 10, 1968, discloses a sea wall structure which has an inclined front face provided with a plurality of spaced steps. U.S. Pat. No. 3,548 600, which issued to J. Stolk et al. on Dec. 22, 1970, discloses a block for constructing an artificial reef which has intersecting cylindrical perpendicular passages. The blocks each have the shape of a six sided quadrangular prism. In use, the blocks are dropped at random in a heap, with the sides of different blocks facing in different directions. U.S. Pat. No. 3,845,630, which issued to J. Karnas on Nov. 5,1974, disclosed a mechanical reef characterized by step-wise arranged deflector panels having a configuration which is effective to cause vertically moving water in waves to absorb its own energy so that the waves are attenuated and the sand and other particulate material carried by the water is deposited below and in front of the reef. U.S. Pat. No. 4,188,153, which issued to J. Taylor on Feb. 12, 1980, discloses a barrier for erosion prevention formed from stacked toroidal objects such as used vehicle tires. The tires are disposed in a plurality of relatively offset layers which are held against relative displacement and are secured together.

While the above mentioned devices are suited for their intended usage, none of these devices disclose an artificial reef formed from a plurality of aligned assembled blocks which have complementary surfaces forming interior corrugated passages extending in first and second perpendicular directions. Additionally, none of the aforesaid artificial reef constructions provide a dual staircase configuration which allows convenient human access to the ocean. Inasmuch as the art is relatively crowded with respect to these various types of artificial reefs, it can be appreciated that there is a continuing need for and interest in improvements to such artificial reefs, and in this respect, the present invention addresses this need and interest.

SUMMARY OF THE INVENTION

In view of the foregoing disadvantages inherent in the known types of artificial reefs now present in the prior art, the present invention provides an improved artificial reef. As such, the general purpose of the present invention, which will be described subsequently in greater detail, is to provide a new and improved artificial reef which has all the advantages of the prior art artificial reefs and none of the disadvantages.

To attain this, a representative embodiment of the concepts of the present invention is illustrated in the drawings and makes use of a plurality of connected adjacent blocks, each having a base with inclined front and back walls connected by vertical side walls in a flat bottom surface. A plurality of rectangular vertical columns are spaced along an upper surface of the base and are sequentially stepped in height from the front end back walls to a maximum height adjacent a mid-portion of the base. A plurality of vertically spaced saw toothed wave forms extend along the base, in aligned pairs on opposite sides of the columns. A plurality of pairs of aligned triangular surfaces project from front and back walls of each column, spaced vertically along the columns in alignment with the saw toothed wave forms. The blocks are assembled in side by side relation, with each block aternately having downwardly extending trapezoidal prismatic projections or mating recesses. When assembled, the blocks form a plurality of interior intersecting passages extending in first and second perpendicular directions. The interior passages have a corrugated interior surface and serve to absorb wave energy from obliquely approaching waves and direct the water flow therefrom either perpendicular to or parallel with the beach line. This prevents erosion of the beach through latorial drift.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved artificial reef which has all the advantages of the prior art artificial reefs and none of the disadvantages.

It is another object of the present invention to provide a new and improved artificial reef which may be easily and efficiently manufactured and marketed.

It is a further object of the present invention to provide a new and improved artificial reef which is of a durable and reliable construction.

An even further object of the present invention is to provide a new and improved artificial reef which is susceptible of a low cost of manufacture with regard to both materials and labor, and which accordingly is then susceptible of low prices of sale to the consuming public, thereby making such artificial reefs economically available to the buying public.

Still yet another object of the present invention is to provide a new and improved artificial reef which provides in the apparatuses and methods of the prior art some of the advantages thereof, while simultaneously overcoming some of the disadvantages normally associated therewith.

Still another object of the present invention is to provide a new and improved artificial reef which is formed from a plurality of aligned assembled blocks having complementary surfaces configured for forming corrugated passages extending in first and second perpendicular directions.

Yet another object of the present invention is to provide a new and improved artificial reef for preventing beach erosion and latorial drift.

Even still another object of the present invention is to provide a new and improved artificial reef which has a dual step construction to enable convenient human access to the ocean.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which these are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
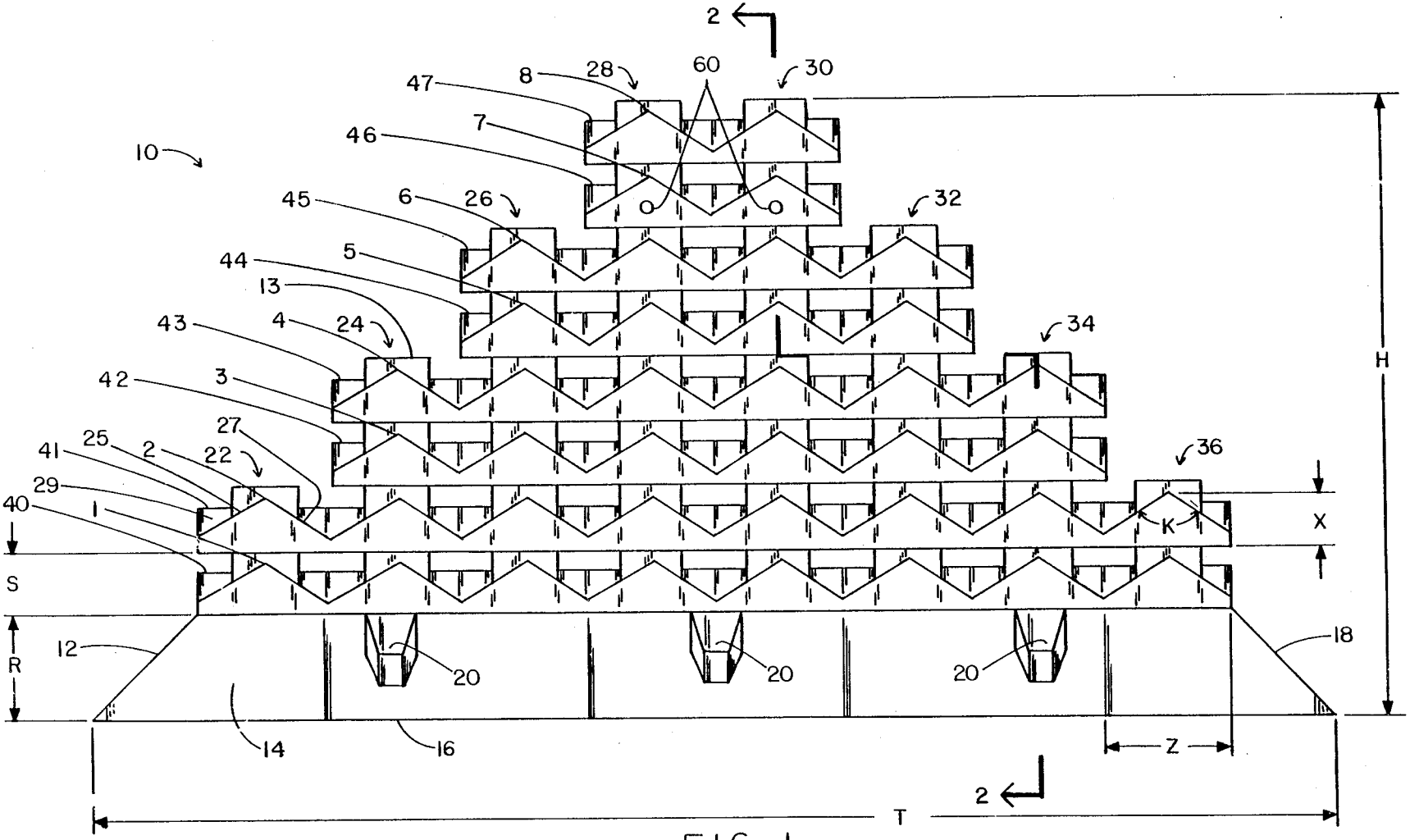
FIG. 1 is a side view of a single block utilized in constructing the artificial reef of the present invention.

With reference now to the drawings, and in particular to FIG. 1 thereof, a new and improved artificial reef embodying the principles and concepts of the present invention and generally designated by the reference numberal 10 will be described.

More specifically, it will be noted that the artificial reef construction block 10 of the invention includes a base having inclined front and back walls 12 and 18 connected by vertical side walls 14 and a flat bottom surface 16. A plurality of rectangular vertical columns 13 are spaced along an upper surface of the base. The columns are sequentially stepped in height from the front 12 and back 18 walls to a maximum height adjacent a mid-portion of the base. This sequential stepped pattern is illustrated at 22, 24, 26, 28, 30, 32, 34 and 36. This configuration serves to attenuate wave energy as described in U.S. Pat. No. 3,845,630, and additionally provides human access to individuals climbing over the block 10 from the back wall 18 to have access to the ocean adjacent the front wall 12. A plurality of vertically spaced saw toothed wave forms extend along the base, in aligned pairs on opposite sides of the columns 13. The leading apex of each wave form is sequentially numbered 1, 2, 3, 4, 5, 6, 7 ane 8 in FIG. 1. Additionally, a plurality of pairs of aligned triangular surfaces project from front and back walls of each of the columns 13. The triangular surfaces are spaced vertically along the columns in alignment with the saw toothed wave forms. The apex of the triangular surface projecting from the front of each columns 22, 24, 26 and 28 are sequentially numbered 40, 41, 42, 43, 44, 45, 46 and 47. The base of each block is preferably formed with a thickness T of about 10 feet and a height R of about 10 inches. The maximum height H of the block 10 is preferably 58 inches, or about 5 feet. The distance S between the base of each pair of vertically spaced saw toothed wave forms is about 6 inches. The altitude X of each triangular tooth of the saw toothed wave forms is about 4 inches. The apex angle K of each of the saw toothed wave forms teeth is about 127 degrees. As illustrated adjacent the saw toothed wave form apex 2, the apex line is formed by an intersection of inclined surfaces 25 and 27. An inclined surface 29 forms half of the triangular surface projecting from the front wall of the column 22, and ends at apex line 41. A plurality of downwardly extending trapezoidal prismatic projections 20 are spaced along the base of the block 10. It should be understood that the opposite side of the block 10 is identical to the side illustrated in FIG. 1. In the assembled reef, alternate blocks are provided with the projections 20 and corresponding mating recesses for engagement with these projections. This forms a strong interlocking connection between adjacent blocks. To further this interlocking connection, a plurality of reinforcement tubes 60 may extend between aligned cylindrical recesses adjacent an upper portion of each block. This provides an enhanced connection between adjacent upper block portions.

Figure 2:
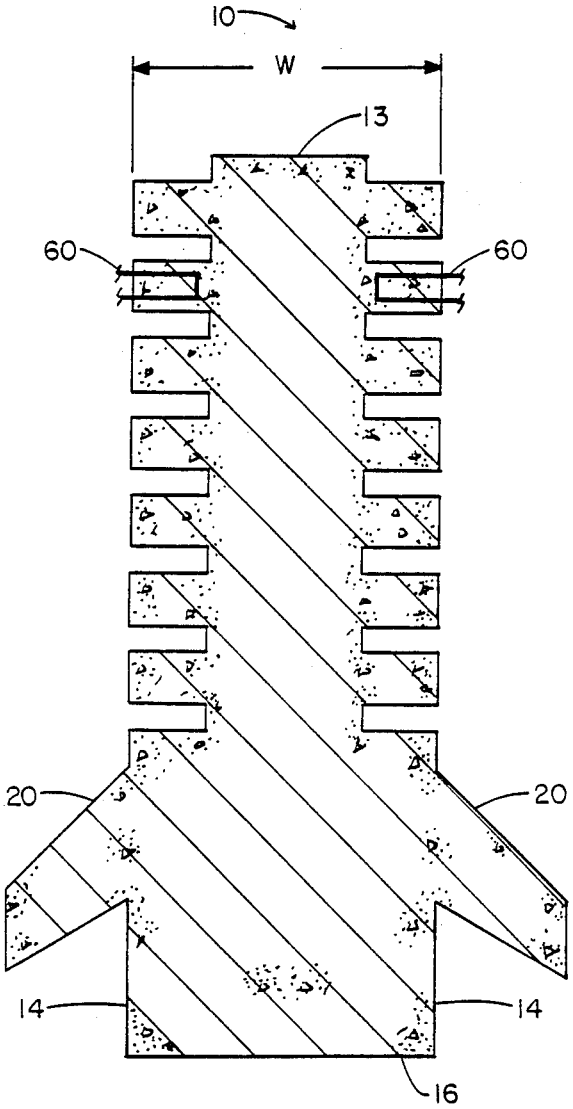
FIG. 2 is a cross sectional view, taken along line 2—2 of FIG. 1.

FIG. 2 provides a cross sectional view which further illustrates the location of the interlocking tubes 60. The block 10 is preferably formed from a reinforced concrete material and may be provided with an internal steel reinforcement cage. Additionally, the concrete is cormed from a portland type II cement with an EMSAC additive and may additionally include a fortifiber additive which is composed of shredded plastic. The resultant cement mixture has a strength rating of 15,000 PSI. The width W of each block is preferably about 2 feet.

Figure 3:
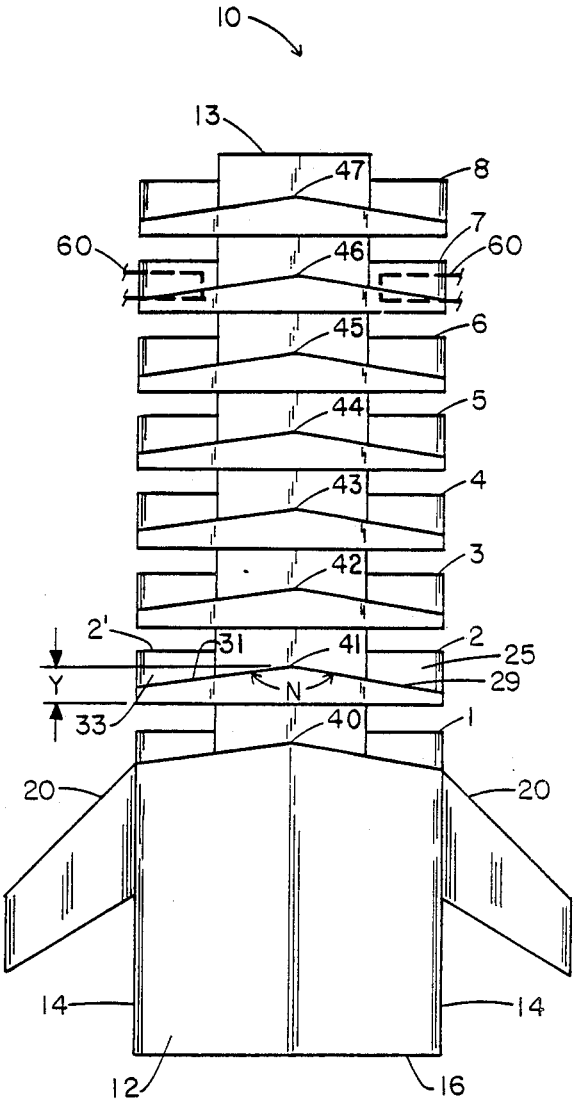
FIG. 3 is a front view of the block of FIG. 1.

FIG. 3 provides a front view of the block 10. As may now be understood, the side walls 14 extend in spaced parallel relation and are connected by the flat bottom surface 16. The projections 20 extend in aligned pairs on opposite side walls 14. The front triangular surfaces projecting in vertically spaced relation along the column 13 are illustrated in FIG. 3. The relative positions of the inclined surfaces 25 and 29, as illustrated in FIG. 1, may be more clearly understood with reference to FIG. 3. The apex angle N of the triangular projecting surfaces is preferably about 152 degrees. The altitude Y is about 4 inches.

Figure 4:
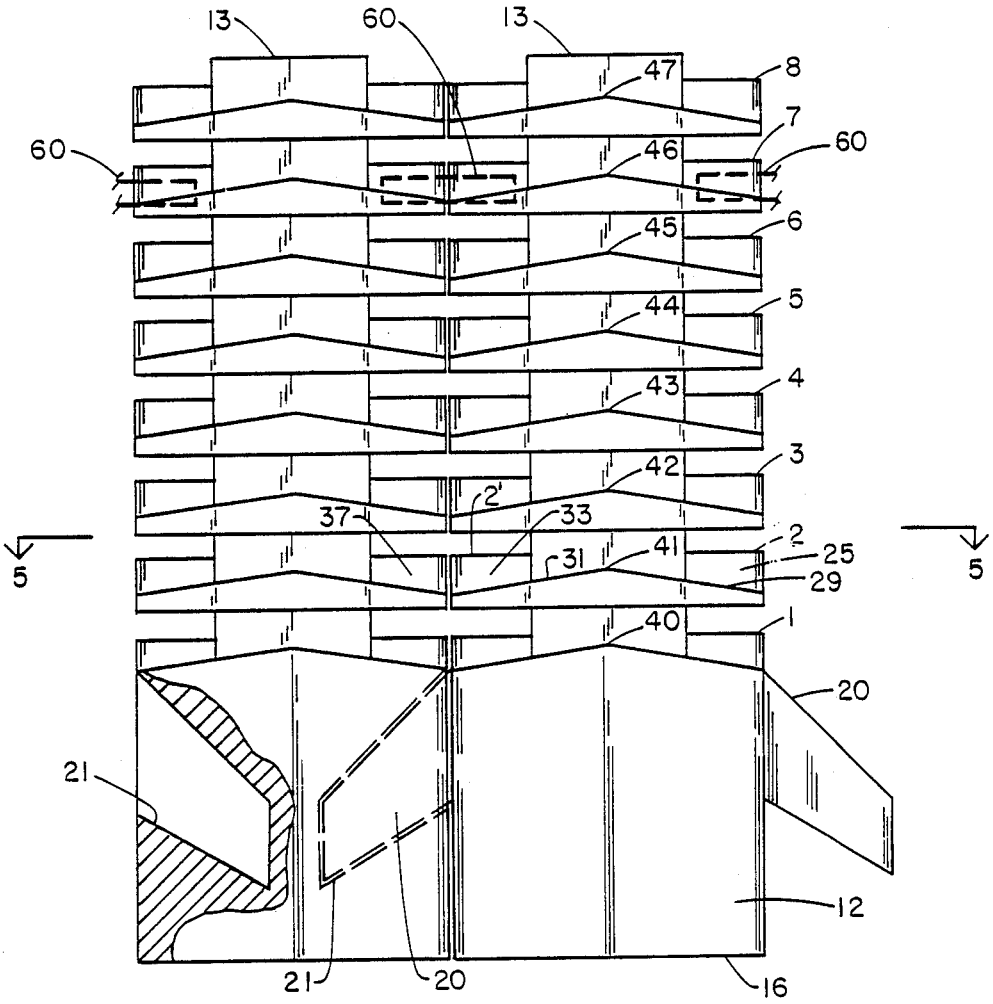
FIG. 4 is a front view, partially cut away, illustrating the assembly in aligned relation of two blocks.

FIG. 4 provides a front view, partially cut away, which illustrates the assembled relation of a pair of blocks. The complementary vertically spaced saw toothed wave forms of the assembled blocks mesh to form corrugated interior passages. The triangular surfaces projecting from adjacent columns also mesh, forming perpendicular interior passages. The mating recesses 21 of alternate blocks are complementary configured for engagement with the projections 20.

Figure 5:
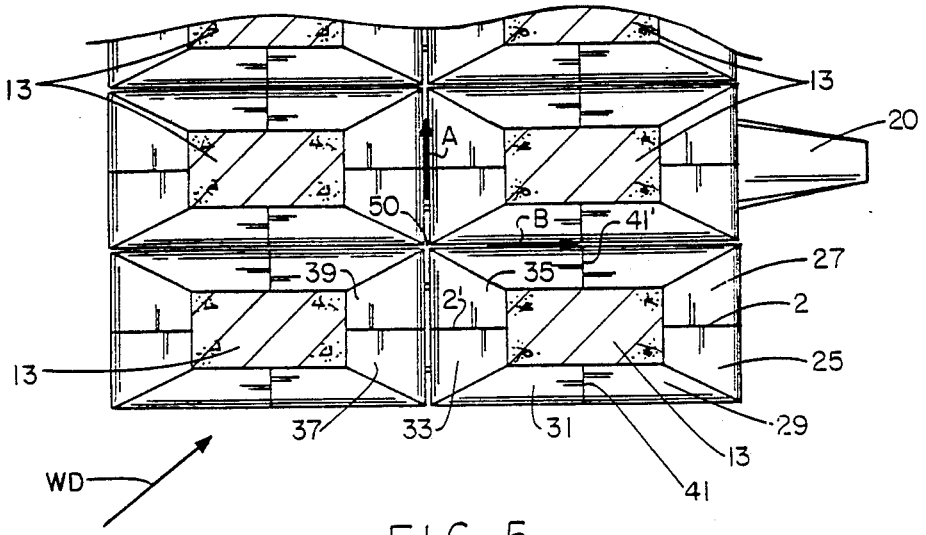
FIG. 5 is a partial cross sectional view, taken along line 5—5 of FIG. 4.

FIG. 5 provides a cross sectional view which illustrate the first corrugated interior passage direction A and the second perpendicular corrugated interior passage B. An interior pocket 50 is formed at each intersection of the passages A and B. When assembled to form an artificial reef, the passages A extend generally perpendicular to the beach line and the passages B extend generally parallel with the beach line. Because of the different dimensions of the saw toothed wave forms forming the passages A and the triangular surfaces forming the passages B, the passages A have a larger cross sectional area than the passages B. As a wave approaches the front of the blocks in an oblique direction as indicated by arrow WD, the water flow through the assembled blocks is forced into interior passages A and B. This prevents an oblique impact of the wave upon the beach, which would result in erosion through latorial drift. The passages A have a corrugated interior surface formed by mating upwardly inclined surfaces 33 and 37 which then extend downwardly from apex line 2' on mating inclined surfaces 35 and 39. Similarly, the surface 29 inclines upwardly to apex line 41 and intersects downwardly inclined surface 31. This provides a corrugated effect to the internal passages A and B which absorbs the wave energy and causes the entrained particulate material and sand to be deposited in the pockets 50 formed at the intersection of the passages A and B. Thus, over time, the interior pockets will fill with sand, thus increasing the strength and mass of the artificial reef.

Figure 6:
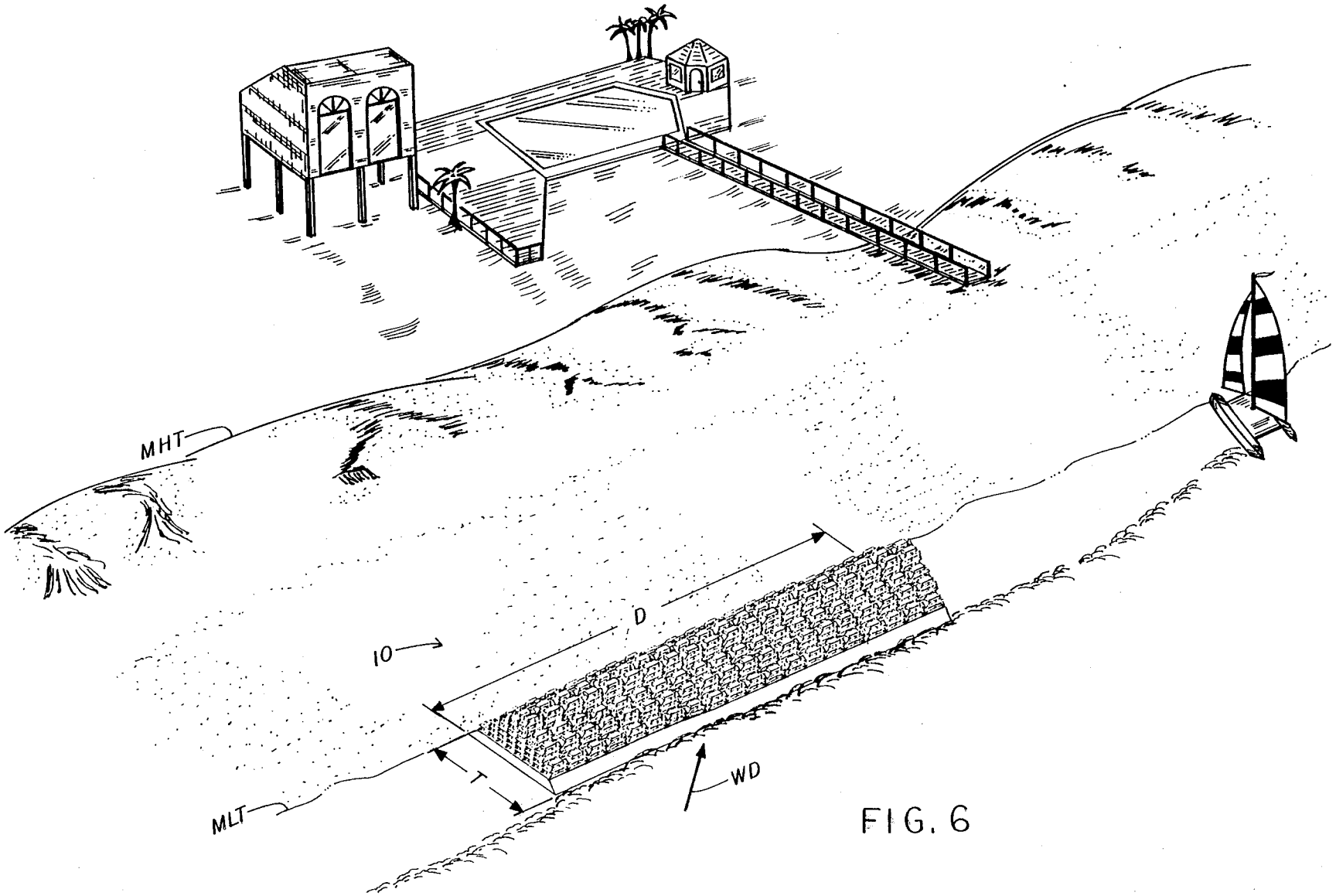
FIG. 6 is a perspective view illustrating the assembled artificial reef of the present invention.

FIG. 6 provides a perspective view which illustrates an assembled artificial reef formed by a plurality of adjacent interconnected blocks. The mean high tide or beach line is indicated at MHT. The reef 10 is preferably constructed along the mean low tide line MLT with the thickness T of the blocks extending generally perpendicular to the beach lint MHT and the mean low tide line MLT. The oblique approaching wave direction is indicated at arrow WD. The blocks may be interconnected in aligned side by side relation to form a reef extending a distance D of any desired extent. However, it is contemplated that a property owner will install a reef along the length of his exposed beach line. Such beach front lots typically extend a distance D of about 100 feet. As each of the blocks has a weight of more than one ton, the combined weight of the assembled blocks firmly anchors the reef in position. Additionally, as described previously, the interior pockets of the reef will fill with sand over time, thus further enhancing the stability of the artificial reef. As the waves approach and impact the front surface of the reef, the wave energy is absorbed and translated into components which extend perpendicular and parallel to the beach. The perpendicular components deposit additional sand on the beach, which is prevented from returning through the reef interior due to the lost energy of the wave. The parallel component of the wave action extends harmlessly along the mean low tide line MLT and does not cause any damage to the beach.

With respect to the above description then, it is to be realized that the optimum dimensional relationships for the parts of the invention, to include variations in size, materials, shape, form function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being hew and desired to be protected by Letter Patents of the United States is as follow:

1. An artificial reef, comprising:

a plurality of aligned adjacent blocks;

each of said blocks including a base having front and back walls connected by sidewalls, an upper surface and a bottom surface;

a plurality of generally vertical columns spaced along said upper surface of said base;

said columns being sequentially stepped in height from said front and back walls to a maximum height adjacent a mid-portion of said base;

and columns on each pair of adjacent blocks having complementary aligned surfaces forming a plurality of intersecting passages extending in first and second perpendicular directions, each of said passages having a corrugated internal surface.

2. The artificial reef of claim 1, wherein an interior pocket is formed at each intersection of said perpendicular passages.

3. The artificial reef of claim 1, wherein said passages extending in said first direction have a greater cross sectional area than said passages extending in said second direction.

4. The artificial reef of claim 1, further comprising:

a plurality of outwardly extending projections spaced along at least one of said side walls of the base of each of said blocks.

5. The artificial reef of claim 1, further comprising:

a plurality of inwardly extending recesses spaced along at least one of said side walls of the base of each of said blocks.

6. The artificial reef of claim 1, wherein each of said blocks is formed from reinforced concrete.

7. The artificial reef of claim 1, wherein each of said blocks has a thickness of about 10 feet, a width of about 2 feet and a maximum height of about 5 feet.

8. The artificial reef of claim 1, wherein said complementary surfaces on each of said blocks include a plurality of vertically spaced saw toothed wave forms extending along said base, in aligned pairs on opposite sides of said columns.

9. The artificial reef of claim 8, further comprising a plurality of pairs of aligned triangular surfaces projecting from front and back walls of each of said columns, said triangular surfaces spaced vertically along said columns in alignment with said saw toothed wave forms.

10. The artificial reef of claim 9, wherein each tooth of said saw toothed wave form has a smaller included apex angle than included apex angles of said triangular surfaces.

11. A block for forming an artificial reef, comprising:

a base having inclined front and back walls connected by vertical side walls and a flat bottom surface;

a plurality of rectangular vertical columns spaced along an upper surface of said base;

said columns being sequentially stepped in height from said front and back walls to a maximum height adjacent a mid-portion of said base;

a plurality of vertically spaced saw toothed wave forms extending along said base, in aligned pairs on opposite sides of said columns; and a plurality of pairs of aligned triangular surfaces projecting from front and back walls of each of said columns, said triangular surfaces spaced vertically along said columns in alignment with said saw toothed wave forms.

12. The block of claim 11, further comprising:

a plurality of outwardly and downwardly extending trapezoidal prismatic projections spaced along each of said side walls.

13. The block of claim 11, further conprising;

a plurality of inwardly and downwardly extending trapezoidal prismatic recesses spaced along each of said side walls.

14. An artificial reef formed from a plurality of connected adjacent blocks, each of said blocks comprising:

a base having inclined front and back walls connected by vertical side walls and a flat bottom surface;

a plurality of rectangular vertical columns spaced along an upper surface of said base;

said columns being sequentially stepped in height from said front and back walls to a maximum height adjacent a mid-portion of said base;

a plurality of vertically spaced saw toothed wave forms extending along said base, in aligned pairs on opposite sides of said columns;

a plurality of pairs of aligned triangular surfaces projecting from front and back walls of each of said columns, said triangular surfaces spaced vertically along said columns in alignment with said saw toothed wave forms; and said blocks assembled in side by side relation, with said blocks alternately having downwardly extending trapezoidal presmatic projections and mating recesses.

15. The artificial reef of claim 14, wherein each of said blocks is formed from reinforced concrete.

16. The artificial reef of claim 14, wherein each of said blocks has a thickness of about 10 feet, a width of about 2 feet and a maximum height of about 5 feet.

17. The artificial reef of claim 14, wherein said adjacent blocks form a plurality of interior intersecting passages extending in first and second perpendicular directions.

18. The artificial reef of claim 17, wherein said passages extending in said first direction have a greater cross sectional area than said passages extending in said second direction.

19. The artificial reef of claim 14, wherein each tooth of said saw toothed wave form has a smaller included apex angle than included apex angles of said triangular surfaces.

* * * * *